US005957664A

United States Patent [19]

Stolz et al.

[11] Patent Number: 5,957,664

[45] Date of Patent: Sep. 28, 1999

[54] GAS PULSATION DAMPENER FOR POSITIVE DISPLACEMENT BLOWERS AND COMPRESSORS

[75] Inventors: Jack Lewis Stolz, Allentown; Mark Allen Story, Kutztown, both of Pa.

[73] Assignee: Air Products and Chemicals, Inc., Allentown, Pa.

[21] Appl. No.: 08/748,484

[22] Filed: Nov. 8, 1996

[51] Int. Cl.[6] ..... F04B 11/00

[52] U.S. Cl. ..... 417/53; 417/312; 417/313; 417/540; 417/542

[58] Field of Search ..... 181/269, 403, 181/250, 276, 273, 296, 206; 417/312, 540, 542, 313, 53

[56] References Cited

U.S. PATENT DOCUMENTS

| | | | |
|---|---|---|---|
| 4,162,904 | 7/1979 | Clay et al. | 55/276 |
| 4,294,330 | 10/1981 | Baldwin et al. | 181/230 |
| 4,529,060 | 7/1985 | Komauer et al. | 181/227 |
| 4,561,865 | 12/1985 | McCombs et al. | 55/25 |
| 4,927,342 | 5/1990 | Kim et al. | 418/63 |
| 5,040,495 | 8/1991 | Harada et al. | 123/52 |
| 5,203,679 | 4/1993 | Yun et al. | 417/312 |

FOREIGN PATENT DOCUMENTS 1359552 12/1987 U.S.S.R. .

*Primary Examiner*—Charles G. Freay
*Attorney, Agent, or Firm*—Geoffrey L. Chase

[57] ABSTRACT

A gas pulsation and noise reduction system for positive displacement blowers and compressors. A resonator is placed in one or both of the inlet and outlet conduits of the blower or compressor. The resonator is sized to damp out gas pulsations by providing a reflected wave 180° out of phase with the gas pulsation in the associated conduit. Multiple resonators can be used in one or both conduits to dampen gas pulsations of different frequencies.

7 Claims, 3 Drawing Sheets

GAS PULSATION DAMPENER FOR POSITIVE DISPLACEMENT BLOWERS AND COMPRESSORS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to reducing gas pulsations and consequently induced noise during the operation of rotary lobe positive displacement blowers or reciprocating compressors of the type used in non-cryogenic gas separation systems.

Non-cryogenic gas separation processes, especially adsorptive processes, are used to separate various components from a gaseous mixture, e.g. oxygen from air. Two major adsorptive processes are currently in use. These are pressure swing adsorption (PSA) and vacuum swing adsorption (VSA). Pressure swing adsorption is carried out with the adsorption (feed) step at pressures much higher than ambient and adsorbent regeneration at pressures close to ambient. In the vacuum swing adsorption (VSA) processes, adsorption is carried out at pressure close to ambient and the adsorbent regeneration is carried out at sub-atmospheric pressure levels. U.S. Pat. No. 4,561,865 illustrates a prior art pressure swing adsorption process and U.S. Pat. No. 4,813,977 illustrates a prior art vacuum swing adsorption process.

Conventional PSA and VSA processes employ positive displacement compressors and blowers for either fluid compression or exhaustion in the adsorbent vessel. A positive displacement compressor or blower ingests a fixed volume of gas, compresses the gas to higher pressure, and discharges the compressed gas into a discharge pipe, conduit or chamber. The flow of gas into and out of the compressor or blower is non-steady due to the nature of the machine taking in fixed volumes of gas at a given frequency. This action creates pressure fluctuations in the inlet and discharge pipes or conduits connected to the compressor or blower. Pressure fluctuations of this type are commonly referred to as gas pulsations.

Gas pulsations can cause problems within the gas separation system such as piping vibrations, air and gas filter distress, noise, adsorbent bed agitation, and water separator inefficiency where the positive displacement apparatus is of the water injected type. Gas pulsations from a positive displacement apparatus (blower or compressor) can be in the range of 10 to 20 percent of the absolute line pressure without some form of pressure pulsation reduction. The gas pulsations act upon any surface within the gas flow path and thus generate a force on such surfaces equal to pressure pulsation amplitude times the surface area.

Piping systems experience shaking forces when gas pulsations act upon flow impingement surfaces such as pipe elbows, tees and associated vessels. The gas pulsations can also produce noise by causing the pipe and vessel surfaces to vibrate and radiate sound pressure waves into the atmosphere much like the diaphragm of a drum. The gas pulsations act upon filters and adsorber beds causing them to vibrate and eventually can cause damage to the filters and beds. In some applications positive displacement blowers employ water injection into the blower to act as a sealant and a coolant. The water must be separated from the gas stream in the blower discharge flow. Gas pulsations adversely effect good separation where smooth flow and low velocity are important parameters for good water-gas separation. In order to achieve good water separation a large separation vessel is required. Large separation vessels contain large surfaces which in turn can radiate noise caused by any gas pulsations within the separator. Therefore, it is desirable to eliminate harmful gas pulsations from the system prior to the gas containing water entering into the separator.

Gas pulsations can be attenuated and or minimized by using surge bottles, resonator bottles, choke tubes, orifices, or diffusers. However, these devices have not been effective in gas pulsation and induced noise reduction with water injected positive displacement blowers or compressors.

U.S. Pat. Nos. 4,927,342 and 5,203,679 disclose use of resonators that are applied to attenuating noise from rotary compressors.

U.S. Pat. No. 4,294,330 discloses use of a muffler device for use with pneumatic devices such as a pneumatic drill.

U.S. Pat. No. 5,040,495 discloses use of a resonator applied to an internal combustion engine.

U.S. Pat. No. 4,162,904 discloses a prior art silencer/separator for use with high velocity gas streams for separating entrained liquid from the gas.

A Russian Patent SU 1359552 A1 discloses suppression of blower pulsations in a power-plant system.

BRIEF SUMMARY OF THE INVENTION

According to the present invention, it has been discovered that gas pulsations can be reduced (attenuated) by installing a Helmholtz type resonator tube in the outlet, and, if necessary, the inlet conduit associated with a positive displacement blower or compressor. The resonator tube is made of a capped tube having a diameter equal to the associated pipe, tube or conduit (inlet or outlet) of the positive displacement apparatus with a length that is equal to one quarter of the wave length of the frequency of the gas pulsation associated with the conduit. More than one resonator tube can be included in the inlet or outlet conduit in the case where there is more than one gas pulsation frequency associated with the device.

DETAILED DESCRIPTION OF THE INVENTION

Figure 1:
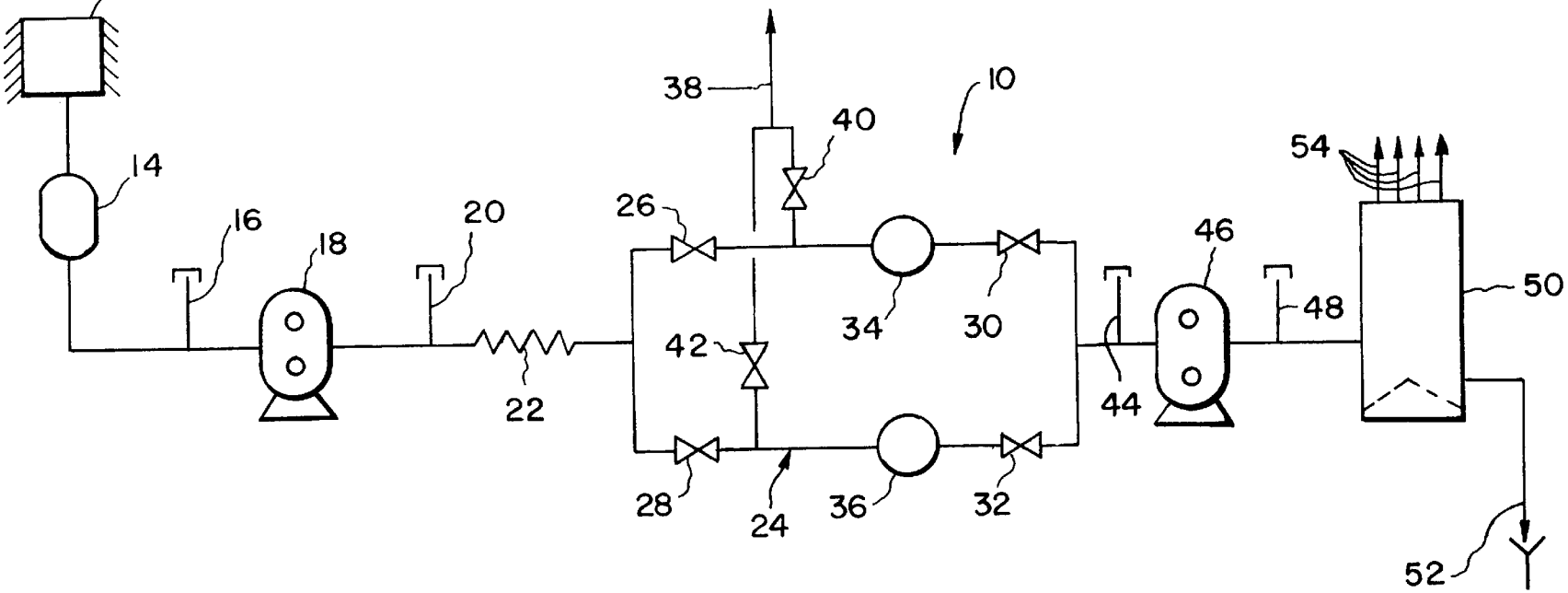
FIG. 1 is a schematic representation of the method and apparatus of the present invention applied to a VSA system.

FIG. 1 shows a typical non-cryogenic air separation system 10 which includes an air inlet filter 12, an inlet silencer 14, an inlet pulsation dampener 16 according to the present invention, as will be more fully described hereinafter, an inlet or air supply blower 18, an outlet pulsation dampener 20, an air cooler 22, and an adsorbent system 24 which includes a series of control valves 26, 28, 30, and 32 so that alternately adsorbers 34 and 36 can be utilized to separate air into its components and withdraw a product represented by arrow 38. Depending upon the process the product 38 can be oxygen or nitrogen. Product discharge valves 40, 42 provide control of the product discharged from the adsorbers 34 or 36. Downstream of the adsorbent system 24 is an inlet pulsation dampener 44, vacuum blower 46 outlet pulsation dampener 48 and a silencer-separator 50. Arrow 52 represents water which is separated from the gaseous discharge from the vacuum blower 46 and arrows 54 represent gases removed from the adsorber vessel which is not being used in the separation cycle.

Figure 2:
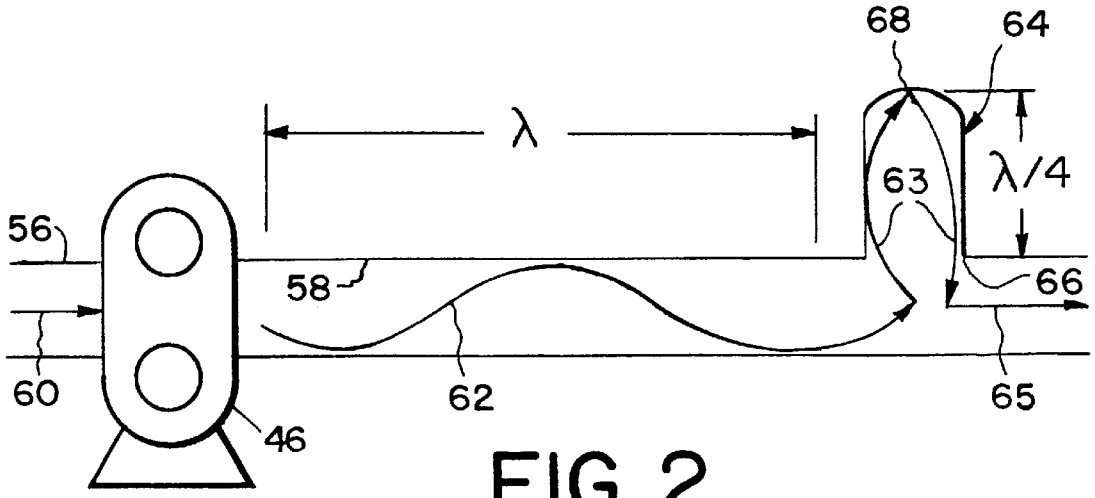
FIG. 2 is a schematic representation of the apparatus of the present invention.

FIG. 2 shows the vacuum blower 46 which has an inlet conduit 56 and an outlet conduit 58. Inlet conduit 56 conducts the adsorbed gases which are represented by an arrow 60 from the adsorbent bed (34 or 36) outwardly of the adsorber system 24.

As is well known positive displacement blowers or compressors produce unique pulsation frequencies which depend upon the operating speed and the design of the gas compression system. For example a rotary lobe blower will produce a gas pulsation frequency equal to its operating speed times the number of lobes on the rotors. Some blowers will produce a single frequency while others can produce multiple frequencies. Reciprocating compressors will typically produce a one or two times running speed pulsation frequency, depending upon their design as a single or a double acting compressor.

According to the invention a pulsation dampener 64 is installed in the discharge conduit 58 for blower 46. The pulsation dampener is of the Helmholtz type.

The Helmholtz resonator is a pulsation dampener which works by canceling gas pulsations by allowing or causing the gas pulsation to work on itself. The operation of the resonator or pulsation dampener is based on the theory that the pulsation has a given discrete frequency and has a certain wave length which is dependent upon the velocity of sound in the operating medium, e.g. gas. If the resonator is constructed so that the pulsation enters the resonator and is reflected back one half wave length later, it will cancel the next pulsation traveling along the pipeline. For example, assuming a pulsation frequency of 50 HZ operating in a gas stream with an acoustic velocity of sound equal to 1100 feet per second (fps), the wave length ($\lambda$) is equal to 1100 fps divided by 50 HZ or 22 feet. If a straight pipe resonator is used with the same cross sectional area as the main pipeline, wherein the resonator is formed as a tee off the main pipe with a length of one quarter of the pulsation wave length, the pulsation will enter the resonator, travel one quarter wavelength, e.g. $\lambda$ equals 22 divided by 4, and bounce back 180° out of phase and cancel the fundamental pulsation. The resonator can take other shapes, such as an open surge bottle, as long as the resonator provides a discrete pulsation reflection 180° out of phase from the pulsation being dampened.

The gas pulsation frequency from the blower 46 can be calculated and is represented by the arrow 62. The Greek letter lambda ($\lambda$) represents the wave length of the gas pulsation emanating from the blower 46. A capped tube Helmholtz resonator 64 is placed in the outlet conduit 58 downstream of the blower 46. The resonator 64 is made from a capped tube having a first or open end 66 having a diameter equal to the diameter of the conduit 58. The height of the capped tube 64 measured from the open end 66 to the top of the cap 68 is one quarter wave length or $\lambda/4$ as shown in the drawing. In operation a gas pulsation entering the discharge conduit 58 enters the resonator 64 and is reflected back one half wave length later thus canceling the next pulsation traveling along the conduit 58. These pulsations in resonator 64 are represented by arrows 63 and the resulting canceled pulsation is represented by arrow 65.

In view of the fact that gas pulsations travel in the piping system at the speed of sound, the pulsations will travel up stream from the blower 46 as well as downstream. Thus, the gas pulsation induced noise can be heard at the inlet filter as well as the outlet separator of the system. Thus, to further quiet the system and to damp out gas pulsations a resonator according to the invention can be installed on the inlet and outlet sides of the air supply blower 18 and the vacuum blower 46 as shown in FIG. 1.

Most of the blowers and compressors used in an adsorptive type air separation plant produce pulsations in the range of frequencies from 10 to 100 HZ. Resonator tubes work well in this range of frequencies as described herein. Higher frequencies such as those in a range of 500 to 4000 HZ are also produced in air separation systems and are commonly referred to as noise. These sound pressure level frequencies are more disturbing to the human ear even though the pressure pulsation level can be very low compared to the low frequency pressure pulsation levels dampened by the resonator tubes. The high frequency noise produced in these plants is antenuated with adsorptive type silencers at the inlet such as shown in FIG. 1 as item 14 and an outlet silencer-separator shown as item 50. Low frequency pulsation dampening resonators reduce the generation of high frequency noise in the system, thus permitting the use of smaller high frequency silencers.

Figure 3:
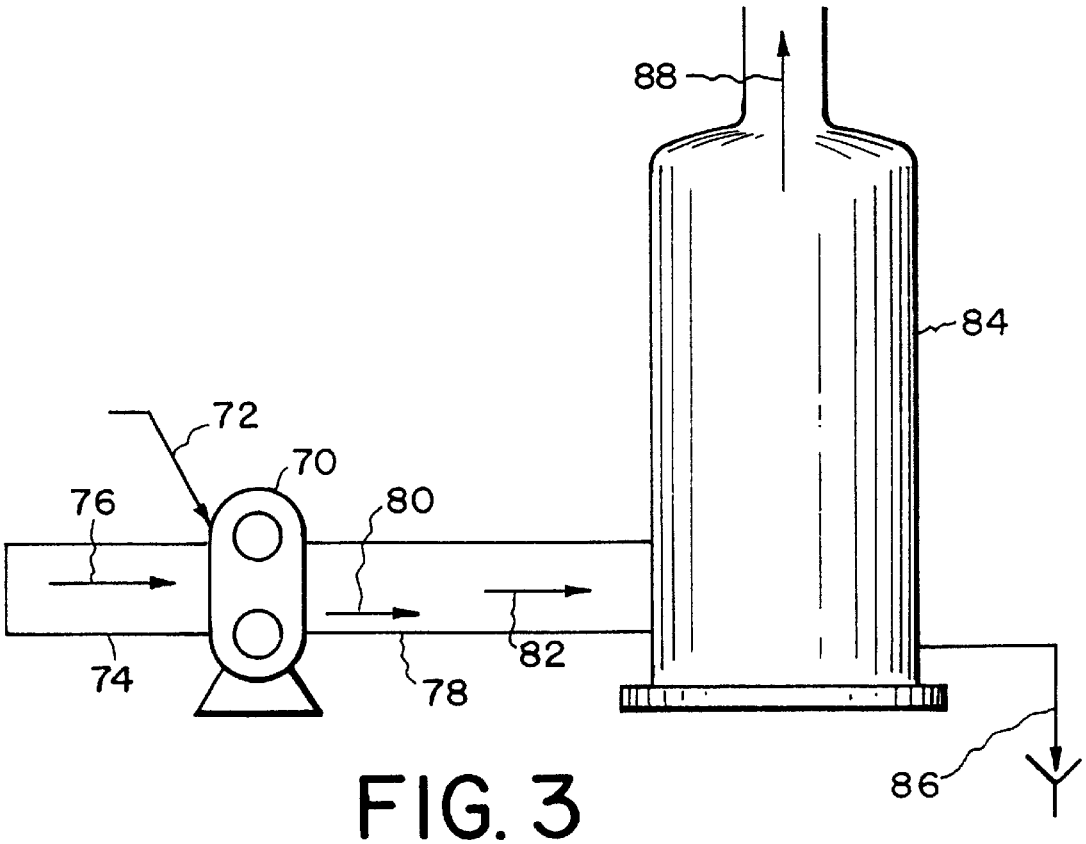
FIG. 3 (PRIOR ART)
FIG. 3 is a schematic representation of a prior art system used with a water injected positive displacement blower.

Referring to FIG. 3 a prior art system for separating out or silencing high frequency noise is shown. Typically a water injected blower 70 with water injection shown by arrow 72 is connected to an inlet conduit 74 which receives gas from the system as represented by arrow 76. Gas and water leave through the discharge conduit 78 as represented by arrows 80 and 82. Typically the gas and water enter a separator-silencer 84 where water is recovered at the bottom through conduit 86 and gas containing residual water is removed through the top of the silencer 84 as represented by arrow 88. The system shown in FIG. 3 suffers from the presence of gas pulsations in the discharge conduit 78. Gas pulsations adversely effect good separation of water from the discharged gas where smooth flow and low velocity are important parameters for good water/gas separation. Thus water is carried out of the separator-silencer with the gas as represented by arrow 88. To achieve good water separation requires a large separator vessel where enlarged surfaces are present to radiate noise caused by gas pulsations within the vessel. Thus, it is necessary to eliminate harmful gas pulsations from the system prior to the gas entering the separator-silencer.

Figure 4:
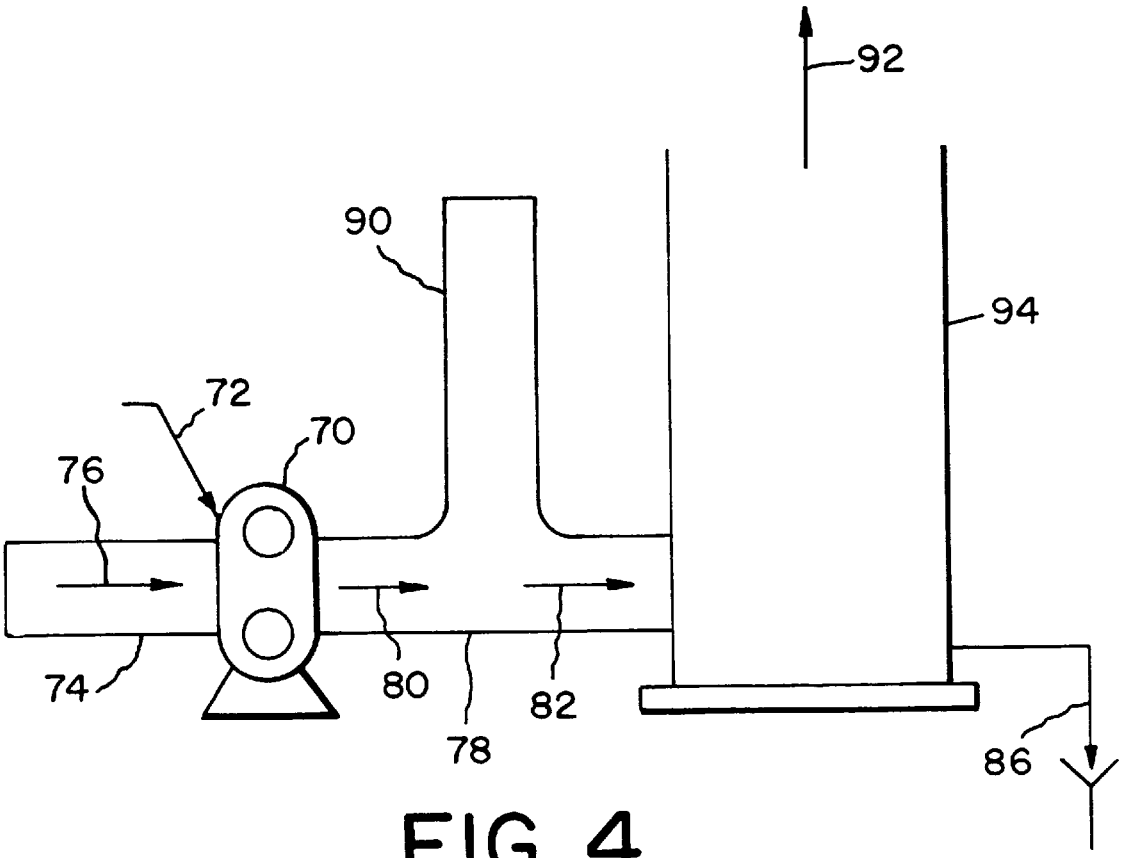
FIG. 4 is a schematic representation of the present invention as applied to a water injected blower.

As shown in FIG. 4 inclusion of a resonator tube 90 between the blower 70 and the separator 94 results in an improved separation of water from gas carryover which is represented by arrow 92. Thus, the separator-silencer 94 can be smaller and more economical to produce.

Some air separation systems have blowers and compressors with one discrete frequency, which requires one pulsation dampener, while others may have two or more discrete frequencies which will require one dampener per discrete frequency.

Use of the resonator according to the invention to eliminate the pressure pulsation results in significant improvements to the operation of an air separation plant. Beginning at the air intake filter, the reduction of pulsations will reduce vibratory stress on the filter unit and improve filter efficiency with smooth flow. The silencer can be smaller due to the reduction of noise causing gas pulsations. The blower may also see a volumetric flow improvement due to a reduction in the gas pulsations. Piping systems and cooler assemblies will benefit from reduced vibration and smooth flow through the cooler assembly. Adsorbent beds will function better with smooth flow and less bed disturbance due to pressure pulsations. The separator-silencer will be greatly improved with smooth flow enhancing the moisture separation from the gas stream and the absence of gas pulsations acting on the separator walls to produce noise generating vibrations.

Testing has shown pressure pulsation levels were reduced from 2.3 psi peak to peak to 0.5 psi peak to peak in a system operating under a pressure of 14.9 psia. Separator-silencer shell vibrations were reduced from 55 mils (0.55 inches) to 1.5 mils (0.015 inches) with drastic reduction in noise.

In a system where there is more than one discrete gas pulsation frequency created by the blower or compressor a resonator tuned for each frequency can be included in the associated piping or conduit.

Although the invention has been described in connection with a simplified VSA air separation process, the invention can be applied to other systems and processes that employ blowers or compressors that produce gas pulsations.

Having thus described our invention what is desired to be secured by Letters Patent of the United States is set forth in the appended claims.

We claim:

1. A method for dampening flow pulsations and resulting noise from operating a water-injected positive displacement apparatus comprising the steps of:

determining the frequency of gas pulsation produced by said apparatus;

installing a Helmholtz type resonator in an outlet conduit of said apparatus, said resonator tuned to create a reflected pressure peak 180° out of phase with a gas pulsation in said conduit containing said resonator; and installing a silencer-separator downstream of said resonator said silencer-separator adapted to separate out water carried over in a gaseous effluent from said apparatus and dampen high frequency noise carried over from said apparatus.

2. A process according to claim 1 including the step of installing a Helmholtz type resonator that will create a reflected pressure peak 180° out of phase with a gas pulsation, in an inlet conduit of said positive displacement apparatus.

3. A process according to claim 1 including the step of selecting a rotary lobe vacuum blower as the positive displacement apparatus.

4. A process according to claim 1 including the step of selecting a reciprocating compressor as the positive displacement apparatus.

5. An apparatus for dampening flow pulsation and resulting noise produced in an adsorptive separation process comprising in combination:

a water injected positive displacement blower having an inlet conduit and an outlet conduit;

a Helmholtz type resonator installed in said outlet conduit, said resonator tuned to create a reflected pressure peak 180° out of phase with a gas pulsation in said conduit; and a silencer-separator downstream of said resonator said silencer-separator adapted to separate out water carried over in a gaseous effluent from said blower and dampen high frequency noise carried over from said blower.

6. An apparatus according to claim 5 wherein a Helmholtz type resonator is installed in the inlet conduit, said resonator tuned to create a reflected pressure peak 180° out of phase with a gas pulsation in said conduit.

7. An apparatus according to claim 5 wherein said resonator is a capped tube installed generally perpendicular to said conduit said tube having a first or open end communicating with an interior of said conduit, and wherein said capped tube and said conduit have identical internal diameters and said capped tube has a length equal to one-quarter of the wave length of said gas pulsation.

* * * * *